US008875918B2

(12) United States Patent
Cerveny et al.

(10) Patent No.: US 8,875,918 B2
(45) Date of Patent: Nov. 4, 2014

(54) CLOSURE

(75) Inventors: Jean-Paul Cerveny, Vittel (FR); Christian Detrois, Golbey (FR)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 13/503,517

(22) PCT Filed: Oct. 21, 2010

(86) PCT No.: PCT/EP2010/065839

§ 371 (c)(1),
(2), (4) Date: Apr. 23, 2012

(87) PCT Pub. No.: WO2011/048166

PCT Pub. Date: Apr. 28, 2011

(65) Prior Publication Data

US 2012/0211506 A1 Aug. 23, 2012

(30) Foreign Application Priority Data

Oct. 23, 2009 (EP) ..... 09173867
Oct. 23, 2009 (EP) ..... 09173868

(51) Int. Cl.
*B65D 17/32* (2006.01)
*B65D 41/40* (2006.01)
*B65D 47/08* (2006.01)

(52) U.S. Cl.
CPC .... *B65D 47/0804* (2013.01); *B65D 2101/0023* (2013.01)
USPC ..... 215/256; 215/235; 220/268

(58) Field of Classification Search
USPC ..... 215/43, 47, 48, 901, 253, 235, 42, 49, 215/40, 216, 210, 209, 258; 220/836, 283, 220/268, 269
See application file for complete search history.

(56) References Cited

U.S. PATENT DOCUMENTS

| | | | | |
|---|---|---|---|---|
| 3,795,558 | A | 3/1974 | Dabney et al. | |
| 3,927,805 | A | 12/1975 | Stull | |
| 4,444,326 | A * | 4/1984 | Musel | 215/209 |
| 5,735,419 | A * | 4/1998 | Ma | 215/253 |
| 6,644,487 | B2 * | 11/2003 | Smith et al. | 215/235 |
| 2011/0297682 | A1 * | 12/2011 | Kwon | 220/268 |

FOREIGN PATENT DOCUMENTS

| | | |
|---|---|---|
| GB | 1123000 | 8/1968 |
| GB | 1276756 | 6/1972 |
| WO | 02/42174 A1 | 5/2002 |

OTHER PUBLICATIONS

Written Opinion and International Search Report mailed Jan. 20, 2011 for corresponding Intl. Appln. No. PCT/EP2010/065839.
Europeoan Office Action dated on Sep. 6, 2013, corresponding to European Patent Application No. 10771709.2.

* cited by examiner

*Primary Examiner* — Mickey Yu
*Assistant Examiner* — Allan Stevens
(74) *Attorney, Agent, or Firm* — K&L Gates LLP

(57) ABSTRACT

The present invention is directed to a packaging (1) comprising a container (2) with a container body (5), and a container opening (6) having an upper edge (7), and a closure (4) for closing said container, the container (2) and the closure (4) being made out of polyethylene terephtalate (PET), polyethylene naphtalate (PEN), or a combination thereof, said container and said closure comprising respectively first (8) and second (9) attachment means, characterized in that: (i) the attachment means (8, 9) are adapted in shape and size to cooperate with each other, and (ii) at least the second attachment means (8) is made of PET or PEN and adapted in shape and size to deform permanently by punching or rolling to link both attachment means, and create a permanent, preferably fluid-tight, arrangement between said container (2) and said closure (4).

20 Claims, 4 Drawing Sheets

CLOSURE

CROSS REFERENCE TO RELATED APPLICATIONS

The present application is a National Stage of International Application No. PCT/EP2010/065839, filed on Oct. 21, 2010, which claims priority to European Patent Application No. 09173868.2, filed on Oct. 23, 2009, and European Patent Application No. 09173867.4, filed on Oct. 23, 2009, the entire contents of which are being incorporated herein by reference.

FIELD OF THE INVENTION

The present invention concerns a packaging comprising at least two parts which are assembled by deforming one portion of the plastic material—preferably polyethylene terephtalate (PET) or polyethylene naphtalate (PEN) of at least one of these parts.

BACKGROUND OF THE INVENTION

A packaging generally comprises a container with a container opening that is closed by a closure element.

The assembly process of the closure element (cap) to the container requires to have cooperating screw threads on these two parts of the packaging, or an equivalent means such as clipping cooperating elements.

There is a need for an alternative system for efficiently and reliably attaching a closure element to a container.

SUMMARY OF THE INVENTION

The technical problem mentioned above is met with a packaging comprising a container with a container body, and a container opening having an upper edge, and a closure for closing said container, the container and the closure being made preferably out of polyethylene terephtalate (PET), polyethylene naphtalate (PEN), or a combination thereof, said container and said closure comprising respectively first and second attachment means According to the invention, the packaging is characterized in that:

(i) the first and second attachment means are adapted in shape and size to cooperate with each other, and (ii) at least the second attachment means are made of PET or PEN and adapted in shape and size to deform permanently by punching or rolling to link both attachment means, and create a permanent, preferably fluid-tight, arrangement between said container and said closure.

The permanent deformation that is applied to the groove wall was found to be possible under certain constraints, and only with PET Polyethylen terephtalat), PETG (glycol-modified polyethylene terephthalate), PEN (Polyethylene Naphthalate), PTT (Poly Trimethylene Terephthalate), PLA (Polylactic acid), PHAs (Polyhydroxyalkanoate) or materials with according stiffness properties. This deformation is permanent and the deformed part is sufficiently strong to prevent the attached part to detach from the other, even when high mechanical constraints are applied to the assembly. Basically, the type of link that is achieved with such an assembly method, is as strong as heat sealing between the two parts.

In a preferred embodiment of the invention, the first attachment means is a groove having one of its walls which is deformable by punching or rolling, and the second attachment means is an extending ridge adapted in shape and size to be inserted into the groove, and in that the closure is attached to the container in a water-tight arrangement by inserting the closure ridge into the container groove and permanently deforming at least one wall of the groove so as to unremovably catch the ridge into the groove.

In a most preferred embodiment of the invention, the first attachment means is a groove having one of its walls which is deformable by punching or rolling, and the second attachment means is an extending ridge adapted in shape and size to be inserted into the groove, and in that the closure is attached to the container by inserting the closure ridge into the container groove and permanently deforming at least one wall of the groove so as to unremovably catch the ridge into the groove. The water-tight sealing of the container is done on the inside of the upper end of the opening of the container by the closure and not at the closure attachment.

Preferably the groove wall is less than 2 mm, preferably less than 1 mm thin so as to be more easily deformable by punching or rolling, and so as to avoid possible problems of cracking or whitening of the plastic material when the deformation is applied. The flexibility and permanent deformation of the material is made possible when the piece to be deformed is sufficiently thin so as to bend, up its point of permanent deformation, without stressing too much the plastic material.

In one first possible embodiment of the invention, the closure can comprise a spout and an overcap attached to the spout, in which case the closure's ridge extends from the lower edge of the spout.

In a second possible embodiment of the invention, the closure element can comprise a ring-shaped base and an overcap attached to the base, in which case the closure's ridge extends from the lower edge of the ring-shaped base.

In all cases, the overcap can advantageously be pivotably attached to the spout or, respectively, to the ring-shaped base, by a pivot hinge.

Preferably in the second possible embodiment of the invention mentioned above, the ring-shaped base is less than 10 mm, preferably less than 3 mm in height.

The overcap mentioned above is preferably made out of polypropylene (PP), and also preferably, said spout and said overcap are manufactured as one single piece.

Further, on top of the plastic deformation that is used as an essential way to assemble the packaging according to the present invention, the closure element can also be attached to the container by ultrasonic sealing.

Preferably, the packaging according to the present invention further comprises tamper-evident means, said means preferably comprising a detachable tamper-evident band that is formed together with the closure, so that it catches one part of the container, thus preventing removal of the closure from said container, unless the said tamper-evident band is torn from the rest of the closure.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
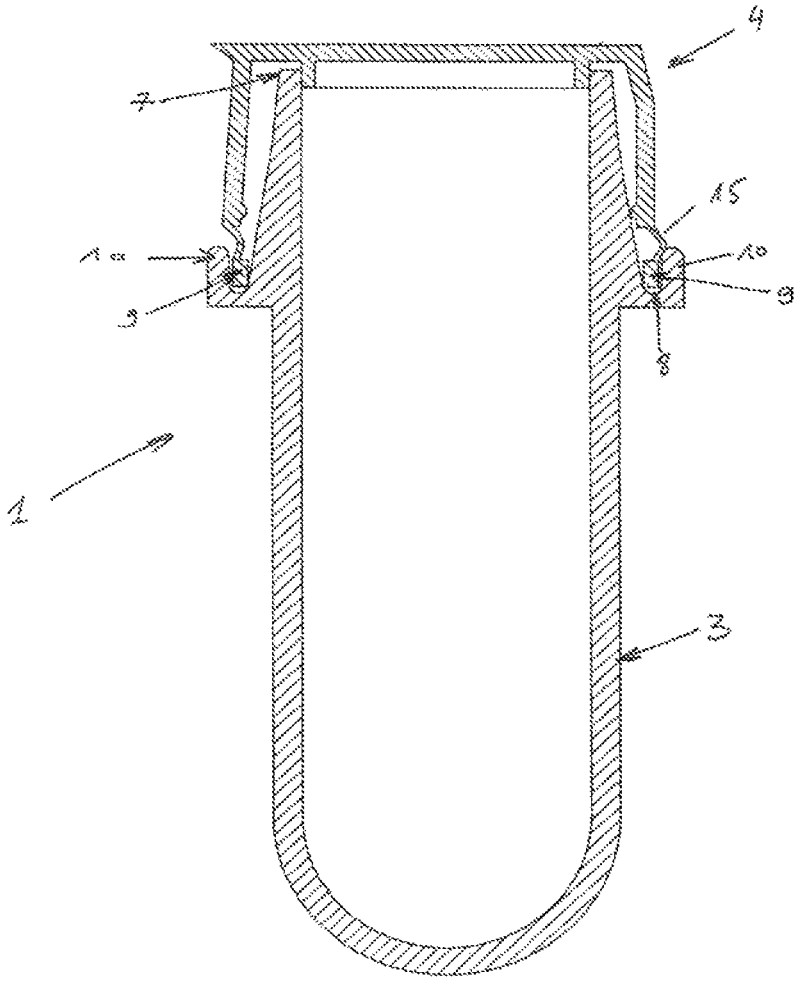
FIG. 1 is a schematic cut profile view showing a packaging assembled according to the present invention, with attachment means not yet deformed.

As illustrated in FIG. 1, the invention concerns a packaging 1 comprising a container 2 made from blow-moulding of a preform 3, the container 2 being closed by a closure 4, and both the bottle 2 and the closure 4 being made of polyolefin, for example PP (polypropylen) or PE (polyethylen).

In the present description, it can be seen from the drawing that FIG. 1 represents a not yet blown bottle, so what is represented in FIG. 1 is the PET preform 3 that will later be blown into a full size bottle.

The container 2 comprises a container body 5 and a container opening having an upper edge. Said container 2 and said closure 4 comprising first and second corresponding attachment means.

According to the invention, the second attachment means are adapted in shape and size to cooperate with the first attachment means, and both attachment means are made of PET and integrally part of the rest of the pieces they are linked to—they could however be added to existing parts, by any means of linking, such as heat sealing, ultrasonic welding for instance—. More than that, both attachment means are adapted in shape and size to deform permanently by rolling to create a permanent arrangement between said container 2 and said closure 4.

Figure 2:
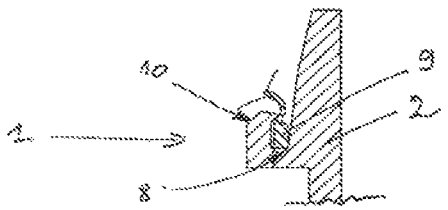
FIG. 2 is an enlarged schematic profile cut view showing the attachment means with one wall of the attachment groove that is deformed to permanently catch the ring-shaped base of a closure.

As can be seen from FIG. 1 and FIG. 2, the first attachment means is a groove 8 having one of its walls 10 which is deformable by rolling, as illustrated in FIG. 2.

The second attachment means is an extending ridge 9 that is adapted in shape and size to be inserted into the groove 8, such that the closure can be attached to the container in an arrangement by inserting the closure ridge into the container groove and permanently deforming the wall 10 of the groove 8 so as to unremovably catch the ridge 9 into said groove 8.

Of course, the example described herein shall not be taken as a limiting example, and for instance the first attachment means of the closure could be a groove, whereas the second attachment means of the container could be a corresponding ridge (inverted positioning of the attachment means relative to the constitutive parts of the packaging.

The deformable groove wall 10 is about 1.5 mm thin so as to be more easily deformable during the rolling operation, and so as to avoid possible problems of cracking or whitening of the plastic material when the deformation is applied. The flexibility and permanent deformation of the material is made possible when the piece to be deformed is sufficiently thin so as to bend, up its point of permanent deformation, without stressing too much the plastic material.

As illustrated in FIG. 1, the closure element comprises a ring-shaped base and an overcap attached to the base. The closure's ridge extends from the lower edge of the ring-shaped base. The overcap is pivotably attached to the spout or, respectively, to the ring-shaped base, by a pivot hinge. The ring-shaped base is about 3 mm in height.

As shown in FIG. 2, the ridge 9 of the closure is disposed into the groove 8 of the preform (or bottle) neck, and the latter is permanently deformed after the rolling operation, in a position that locks the ridge 9 into the groove 8, so that the closure 4 is permanently attached to the neck of the container 2.

The groove is a U-shaped groove with a height of at least 2, preferably at least 3 mm, and a width sufficient to accommodate the ridge of the closure.

Figure 3:
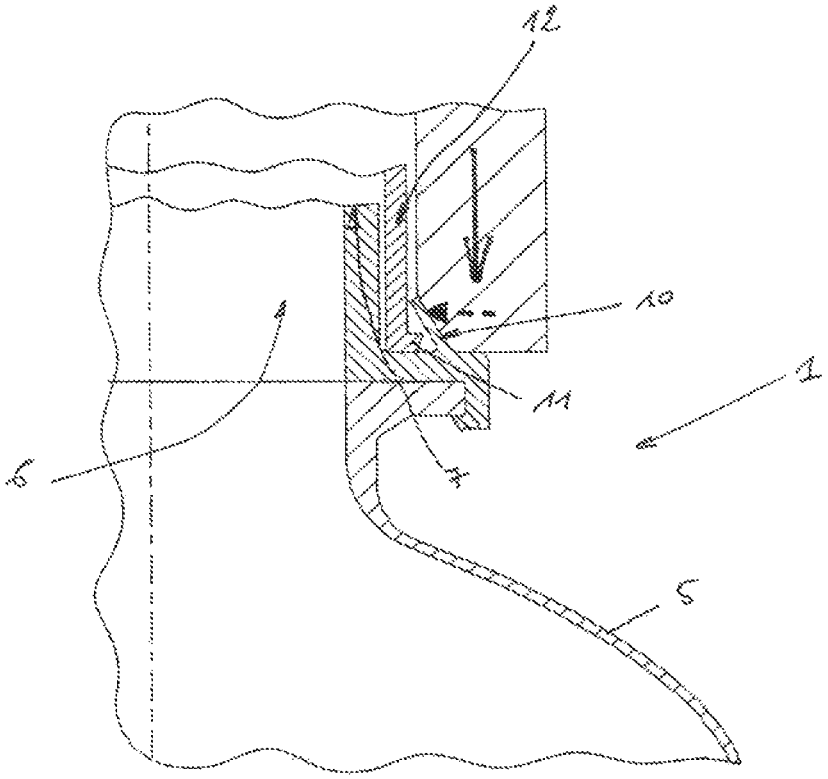
FIG. 3 is an partial profile schematic cut view showing how different parts of the packaging are assembled by rolling in conjunction with ultrasonic sealing.

The permanent deformation can be performed by punching, rolling, cold forming, hot forming, or a combination thereof. As illustrated in FIG. 3, the permanent deformation technique cited before can also be used in combination with ultrasonic welding, so that when the second attachment means is deformed to catch the first attachment means, in order to create a connection between said container and said closure (over-cap), an additional ultrasonic welding step is performed to create a permanent seal between the container 5 and the spout 7. At the sealed interface between these two parts of the packaging, the plastic material is melted, and then colds back to its initial solid state, in such a way that the spout and the container form one single integral piece. Such a ultrasonic welding operation is performed in this case with a sonotrode, which also plays the role of a puncher that deforms the attachment means of the container, before (or at the same time) transmitting ultrasonic waves to seal the spout) and the container together.

The permanent deformation of the PET or PEN is performed at a temperature comprised between 0° C. and the glass transition temperature of the plastic material. This temperature of glass transition is well defined for both thermoplastics used in the present invention. For PET, the temperature of glass transition is Tg=69° C. For PEN, this temperature of glass transition is Tg=122° C. However, preferably the permanent deformation is applied at a temperature which is comprised in a more restricted range, and a range which is closer to ambient temperature, that is to say a temperature comprised between 18° C. and 40° C., more preferably at a temperature comprised between 20° C. and 30° C.

In the example shown in FIG. 3, the attachment means of the container 2 is a circular ridge 9, that is deformed inwardly towards the centre of the container 2, and catches the attachment means of the closure, which is a horizontal extension 11 of the closure skirt 12.

Actually, the attachment means of the container and/or the closure could be not entirely circular (i.e. all around the periphery), but rather on a portion of the circumference of the container and/or closure, or even at very specific points of the said container and/or closure.

Figure 4:
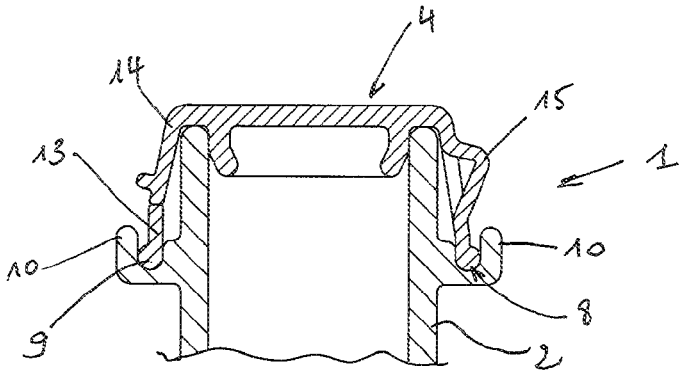
FIG. 4 is a schematic profile cut view showing the top portion of a packaging according to the invention, before the attachment means of the container are deformed to attach the closure element to said container.
Figure 5:
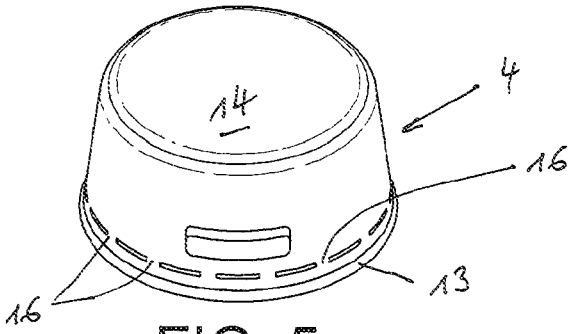
FIG. 5 is a perspective top view showing a closure element.
Figure 6:
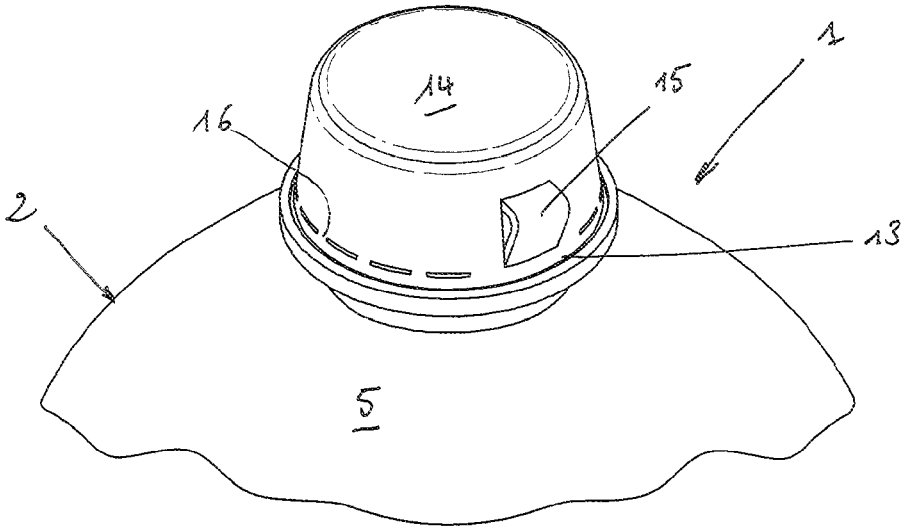
FIG. 6 is a perspective top view similar to FIG. 4.

As illustrated in FIGS. 4, 5 and 6, the closure 4 can be a hinged closure, comprising a base ring 13 and an overcap 14 that is pivotably attached to the ring 13 by a hinge 15.

As shown in FIG. 4, the lower part of the ring 13 is disposed into a groove 8 of the bottle neck, before a wall 10 of said groove is deformed to permanently catch the ring 13, as described before. In that case and as shown in FIG. 5 and FIG. 6, the overcap 14 is moulded as one integral piece with the ring 13, but these two parts are linked via breakable bridges 16, which are broken by tearing when the used first lifts the overcap 14 to open the closure 4. This systems constitutes a tamper-evident means.

Figure 7:
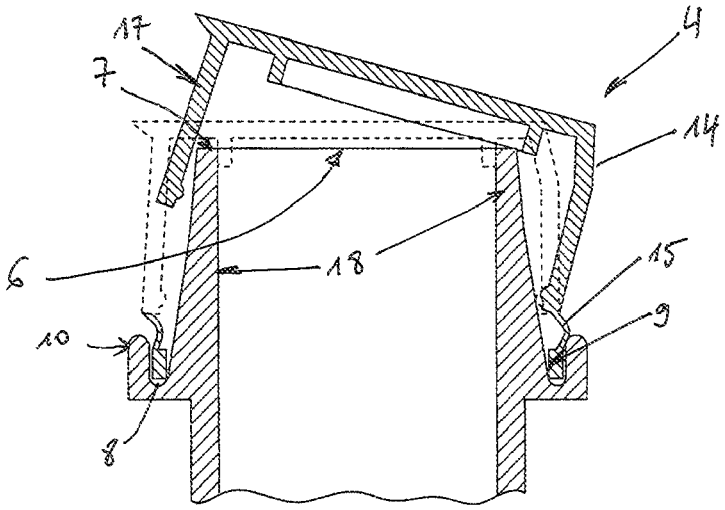
FIG. 7 is a view similar to FIG. 4, where a hinged overcap is partially open; this figure illustrates the difficulty to pivot completely the overcap in open position when the walls of the spout and the over cap are tall.

However, as shown in FIG. 7, there can be a problem for lifting the overcap 14 due to the functional dimensions of said overcap: in that case, it can be become impossible to lift the overcap as its front wall 17 will be stopped by the container neck 18.

Figure 8:
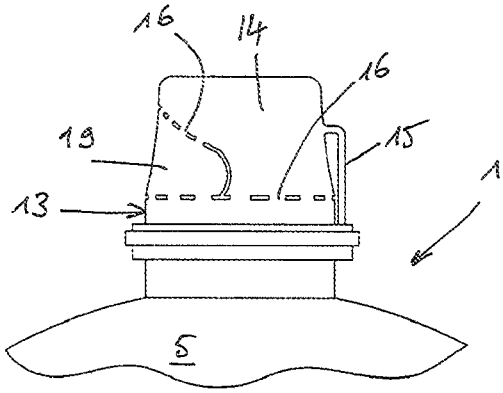
FIG. 8 is profile view showing the top portion of a packaging according to the invention, where the overcap comprises a tamper-evident detachable front tab.
Figure 9:
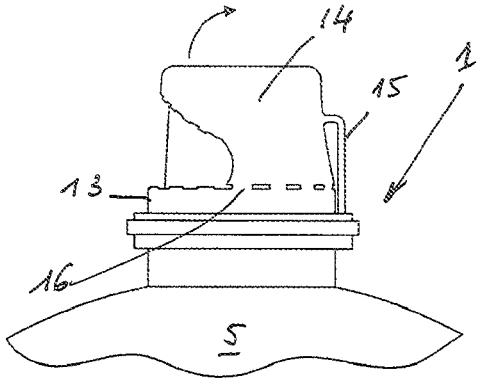
FIG. 9 is a view similar to FIG. 8, wherein the detachable front tab was removed in order to allow complete lifting of the overcap.

In order to avoid the potential problem illustrated in FIG. 7, the closure front wall 17 is preferably equipped with a detachable front wall portion 19 as illustrated in FIG. 8, that can be torn off before lifting the overcap 14 in open position of the closure, as shown in FIG. 9.

This detachable portion 19 is moulded as an integral portion of the rest of the closure 4, but linked to the latter by breakable bridges 16 of plastic material. This detachable front wall portion 19 of the closure can be also integral to the ring 13 of the closure (embodiment not shown in the drawing), or alternatively it can be also detachable from the ring 13, as illustrated in FIG. 9.

Figure 10:
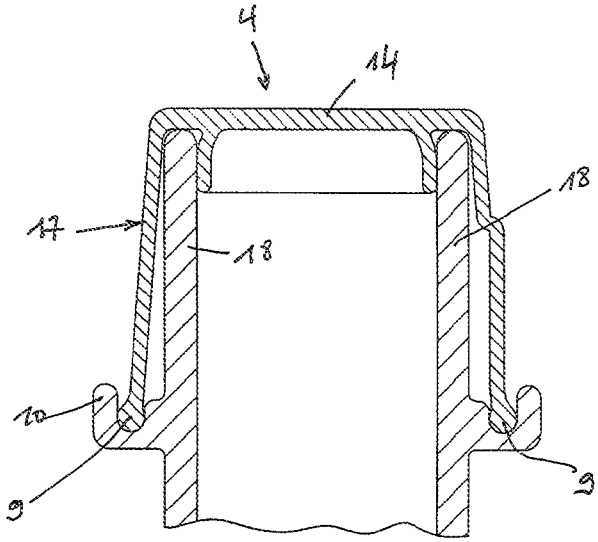
FIG. 10 is a view similar to FIG. 4 showing high closure walls.

As shown in FIG. 10, a detachable front wall portion 19 of the closure 4, makes it possible for a very tall neck 18 of the closure which will still be closed with a hinged closure.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The process according to the invention is more specifically disclosed in the claims.

Claim 1 deals with a packaging (1) comprising a container (2) with a container body (5), and a container opening (6) having an upper edge, and a closure (4) for closing said container, the container (2) being made out of PET Polyethylen terephtalat), PETG (glycol-modified polyethylene terephthalate), PEN (Polyethylene Naphthalate), PTT (Poly Trimethylene Terephthalate), PLA (Polylactic acid), PHAs (Polyhydroxyalkanoate) or a combination thereof, and the closure being made out of PE (polyethylen) or PP (polypropylen) or a combination thereof, said container and said closure comprising respectively first (8) and second (9) attachment means, characterized in that:

(i) the attachment means (8, 9) are adapted in shape and size to cooperate with each other, and (ii) at least one of the first (8) and/or second (9) attachment means is made of PET, PEN, PETG, PTT, PLA, or PHA and adapted in shape and size to deform permanently by punching or rolling to link both attachment means, and create a permanent, arrangement between said container (2) and said closure (4).

Claim 2 deals with a container (1) according to claim 1, wherein the first attachment means is a groove (8) having at least one of its walls (10) which is deformable by punching or rolling, and the second attachment means is a extending ridge (9) adapted in shape and size to be inserted into the groove (8), and in that the closure (4) is attached to the container (2) in a arrangement by inserting the closure ridge (9) into the container groove (8) and permanently deforming at least one wall (10) of the groove (8) so as to unremovably catch the ridge (9) into the groove (8).

Claim 3 deals with a container (1) according to claim 1, wherein the deformable groove wall (10) is less than 2 mm, preferably less than 1 mm thin so as to be deformable by punching or rolling.

Claim 4 deals with a container (1) according to any of the preceding claims, wherein the closure (4) comprises a spout and an overcap attached to the spout, and the closure's ridge (9) extends from the lower edge of the spout.

Claim 5 deals with a packaging (1) according to claim 1, wherein the closure element (4) comprises a ring-shaped base (13) and an overcap (14) attached to the base (13), and wherein the closure's ridge (9) extends from the lower edge of the ring-shaped base (13).

Claim 6 deals with a packaging (1) according to claim 2 or 3, wherein the overcap (14) is pivotably attached to the spout or, respectively, to the ring-shaped base (13), by a pivot hinge (15).

Claim 7 deals with a packaging (1) according to claim 4 or 5, wherein the ring-shaped base (13) is less than 10 mm, preferably less than 3 mm in height.

Claim 8 deals with a packaging (1) according to any of the preceding claims 2 to 7, wherein said overcap (14) is made out of polypropylene (PP) OR PE (polyethylene).

Claim 9 deals with a packaging (1) according to any of the preceding claims 2 to 8, wherein spout and overcap are manufactured as one single piece.

Claim 10 deals with a packaging (1) according to any of the preceding claims, wherein the closure element (4) is also attached to the container (2) by ultrasonic sealing.

Claim 11 deals with a packaging (1) according to any of the preceding claims, which comprises tamper-evident means, said means preferably comprising a detachable tamper-evident band that is formed together with the closure (4), so that it catches one part of the container, thus preventing removal of the closure from said container, unless the said tamper-evident band is torn from the rest of the closure.

The invention claimed is:

1. A packaging comprising:

a container having a container body, and a container opening having an upper edge, the container made out of a material selected from the group consisting of PET (Polyethylene terephtalate), PETG (glycol-modified polyethylene terephthalate), PEN (Polyethylene Naphthalate), PTT (Poly Trimethylene Terephthalate), PLA (Polylactic acid), PHAs (Polyhydroxyalkanoate) and combinations thereof, a closure for closing the container, the closure made out of a material selected from the group consisting of PE (polyethylene), PP (polypropylene) and combinations thereof, the container and the closure comprising respectively first and second attachment members:

the attachment members are adapted in shape and size to cooperate with each other, the first attachment member is integral with and directly extends from the container, at least one of the first or second attachment members is made of a material selected from the group consisting of PET, PEN, PETG, PTT, PLA, and PHA and adapted in shape and size to deform permanently to link both attachment members and create a permanent arrangement between the container and the closure, the first attachment member is a groove having an outer wall that is angled inward toward the container, the second attachment member is an extending ridge inserted into the groove, and a radial distance between an upper edge of the outer wall and a portion of the container on an opposite side of the groove relative to the outer wall is less than a radial width of the extending ridge, and the closure comprises an overcap comprising a detachable front wall portion, the overcap pivotably attached to a ring-shaped base by a pivot hinge, and the detachable front wall portion is partially defined by breakable bridges that extend upward from the ring-shaped base so that the detachable front wall portion extends upward higher than an uppermost portion of the hinge.

2. The packaging according to claim 1, wherein the closure is attached to the container by inserting the extending ridge into the groove and permanently deforming the outer wall of the groove so as to unremovably catch the extending ridge into the groove.

3. The packaging according to claim 1, wherein the outer wall has a thickness that is less than 2 mm.

4. The packaging according to claim 1, wherein the pivot hinge is positioned on an opposite side of the closure relative to the detachable front wall portion.

5. The packaging according to claim 1, wherein the extending ridge extends from a lower edge of the ring-shaped base.

6. The packaging according to claim 1, wherein the extending ridge comprises a horizontal extension at a lower end of the extending ridge, and the radial distance between the upper edge of the outer wall and the portion of the container on the opposite side of the groove relative to the outer wall is less than the radial width of the horizontal extension.

7. The packaging according to claim 1, wherein the ring-shaped base is less than 10 mm in height.

8. The packaging according to claim 1, wherein said overcap is made out of a material selected from the group consisting of polypropylene (PP) and PE (polyethylene).

9. The packaging according to claim 1, wherein the ring-shaped base and the overcap are manufactured as one single piece.

10. The A-packaging according to claim 1, wherein the closure is also attached to the container by ultrasonic sealing.

11. The A-packaging according to claim 1, which comprises a tamper-evident member.

12. A container comprising:

a container body, an opening, and a closure for closing the container, the container body being made of a material selected from the group consisting of PET (Polyethylene terephtalate), PETG (glycol-modified polyethylene terephthalate), PEN (Polyethylene Naphthalate), PTT (Poly Trimethylene Terephthalate), PLA (Polylactic acid), PHAs (Polyhydroxyalkanoate) and combinations thereof, and the closure being made out of a material selected from the group consisting of PE (polyethylene), PP (polypropylene) and combinations thereof, the container body and the closure comprising respectively first and second attachment members:

the attachment members are designed to cooperate with each other, the first attachment member is integral with and directly extends from the container body, at least one of the first or second attachment members is made of a material selected from the group consisting of PET, PEN, PETG, PTT, PLA, and PHA and adapted in shape and size to deform to couple both attachment members, and create a permanent coupling between the container body and the closure, the first attachment member is a groove having an outer wall that is angled inward toward the container body, the second attachment member is an extending ridge inserted into the groove, and a radial distance between an upper edge of the outer wall and a portion of the container on an opposite side of the groove relative to the outer wall is less than a radial width of the extending ridge, and the closure comprises an overcap comprising a detachable front wall portion, the overcap pivotably attached to a ring-shaped base by a pivot hinge, and the detachable front wall portion is partially defined by breakable bridges that extend upward from the ring-shaped base so that the detachable front wall portion extends upward higher than an uppermost portion of the hinge.

13. The packaging according to claim 1, wherein the ridge is circular and surrounds a circumference of the container body.

14. The packaging according to claim 1, wherein the groove is circular and surrounds a circumference of the container body.

15. The container according to claim 12, wherein the ridge is circular and surrounds a circumference of the container body.

16. The container according to claim 12, wherein the groove is circular and surrounds a circumference of the container body.

17. A packaging comprising:

a container having a container body, and a container opening having an upper edge;

a closure for closing the container, the container and the closure comprising respectively first and second attachment members:

the first attachment member is integral with and directly extends from the container, the first attachment member is a groove, and the second attachment member is an extending ridge inserted into the groove, and the closure comprises an overcap comprising a detachable front wall portion, the overcap pivotably attached to a ring-shaped base by a pivot hinge, and the detachable front wall portion is partially defined by breakable bridges that extend upward from the ring-shaped base so that the detachable front wall portion extends upward higher than an uppermost portion of the hinge.

18. The packaging according to claim 17, wherein the extending ridge extends from a lower edge of the ring-shaped base.

19. The packaging according to claim 17, wherein the ridge is circular and surrounds a circumference of the container body.

20. The packaging according to claim 17, wherein the groove is circular and surrounds a circumference of the container body.

* * * * *